US005179066A

United States Patent [19]

Yamada et al.

[11] Patent Number: 5,179,066

[45] Date of Patent: Jan. 12, 1993

[54] THERMOSENSITIVE RECORDING MATERIAL

[75] Inventors: Manabu Yamada; Toshiro Narizuka, both of Kyoto; Katsuhiko Tsunemitsu, Uji; Hajime Kawai, Tsuzuki; Takayuki Kurosaki, Himeji, all of Japan

[73] Assignees: Yamada Chemical Co., Ltd., Kyoto; Nagase Chemicals Ltd., Osaka, both of Japan

[21] Appl. No.: 866,052

[22] Filed: Apr. 8, 1992

[30] Foreign Application Priority Data

Apr. 16, 1991 [JP] Japan ..... 3-177852
Nov. 11, 1991 [JP] Japan ..... 3-352549

[51] Int. Cl.[5] ..... B41M 5/30

[52] U.S. Cl. ..... 503/209; 503/208; 503/225

[58] Field of Search ..... 503/209, 208, 225

[56] References Cited

U.S. PATENT DOCUMENTS 4,599,271 7/1986 Chao ..... 503/215

FOREIGN PATENT DOCUMENTS 58-57989 4/1983 Japan .
59-155096 9/1984 Japan .
60-259494 12/1985 Japan .
61-263794 11/1986 Japan .
63-64795 3/1988 Japan .
2-184489 7/1990 Japan .
3-71885 3/1991 Japan .

*Primary Examiner*—Pamela R. Schwartz
*Attorney, Agent, or Firm*—David G. Conlin; Donald R. Castle

[57] ABSTRACT

This invention relates to a thermosensitive recording material containing at least one of durene derivative represented by the formula (I):

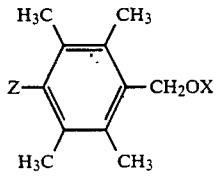

(I)

wherein Z represents $CH_2OX$ or H, X represents an alkyl group, a cycloalkyl group, a substituted or unsubstituted aralkyl group or aryl group, or —COR group where R represents an alkyl group or a substituted or unsubstituted aryl group, in a recording layer which contains a leuco dye and a color-developing agent which reacts with said dye so as to form a color by heating, and the thermosensitive recording material having high color sensitivity can be obtained.

3 Claims, No Drawings

THERMOSENSITIVE RECORDING MATERIAL

BACKGROUND OF THE INVENTION

The present invention relates to a thermosensitive recording material, more specifically to a thermosensitive recording material improved particularly in color sensitivity.

A thermosensitive recording material generally comprises a support such as a paper, a synthetic paper, a film, etc. and a recording layer usually comprising a colorless or pale color leuco dye and a color-developing agent provided thereon, and a recording image appears instantaneously through the reaction of the leuco dye and the color-developing agent with heating.

A recorder utilizing the aforesaid thermosensitive recording material is a small sized and inexpensive, causes no noise and is easy in maintenance since it has a relatively simple structure. Also, it is extremely inexpensive in running costs as compared with an electrostatic recording system, a thermal transfer system, a stamp printing system or an ink ribbon system, and there is less fear in contaminating hands and clothes with an ink so that, in recent years, there is a great demand for recording materials such as a facsimile, a printer, a ticket machine, a label, etc. in many fields.

As properties required for a thermosensitive recording material, there are mentioned no background fog, high sensitivity to a thermal head and a thermal pen and high in color density, high in coloring initiation temperature, good in image storage stability, etc.

Of these, with regard to improvement in color sensitivity which is a particularly important property, improvements have been attempted by adding a heat-fusing substance having a relatively low melting point as a sensitizer (sensitivity improving agent) in addition to a leuco dye and a color-developing agent. For example, in Japanese Patent Publication No. 4160/1968, Japanese Patent Application Laid-Open No. 19231/1973, Japanese Patent Publication No. 17748/1974 and No. 14531/1975, Japanese Patent Application Laid-Open No. 89994/1982 and No. 82382/1985, etc., many compounds such as acetanilide, paraffin, a higher fatty acid ester, a phthalic acid ester, stearic acid amide, m-terphenyl, p-benzylbiphenyl, etc., and stearic acid amide, p-benzylbiphenyl, etc. are particularly used with a large amount.

However, accompanying with the requirement of high speed and low energy consumption to a recorder in recent years, properties are insufficient in a thermosensitive recording material using a conventional sensitizer and also there are insufficient points in properties such as background fog, coloring initiation temperature, image storage stability, etc.

The present invention has been accomplished in view of the above situation and an object thereof is to provide a thermosensitive recording material having high sensitivity and also having good other properties.

SUMMARY OF THE INVENTION

An object of the present invention is to provide a thermosensitive recording material having a recording layer containing a leuco dye, a color-developing agent which reacts with said dye so as to form a color by heating, and at least one of durene derivatives represented by the formula (I):

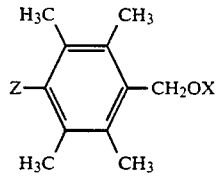

(I)

wherein Z represents $CH_2OX$ or H, X represents an alkyl group, a cycloalkyl group, a substituted or unsubstituted aralkyl group or aryl group, or —COR group where R represents an alkyl group or a substituted or unsubstituted aryl group.

DETAILED DESCRIPTION OF THE PRESENT INVENTION

The durene derivative to be contained in a recording layer of a thermosensitive recording material of the present invention is a compound represented by the formula (I):

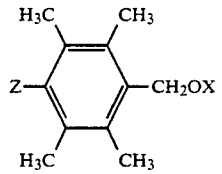

(I)

In the formula, Z represents $CH_2OX$ or H, X represents a straight or branched alkyl group having preferably 1 to 8 carbon atoms such as methyl, ethyl, propyl, butyl groups, etc., a cycloalkyl group having preferably 4 to 7 carbon atoms such as cyclopentyl, cyclohexyl groups, etc., an aralkyl group having preferably 7 to 11 carbon atoms such as a substituted or unsubstituted benzyl group, an aryl group having preferably 6 to 14 carbon atoms such as a phenyl group, etc., or —COR group. As a substituent for the aralkyl group or aryl group, there may be preferably mentioned a halogen atom such as chlorine, bromine, iodine, etc., a straight or branched alkyl group having 1 to 8 carbon atoms, an alkoxy group having 1 to 8 carbon atoms such as methoxy, ethoxy, butoxy, etc., and a phenoxy group, and a number of the substituent is preferably 1 to 4. Also, R of the —COR group is an alkyl group as mentioned above or a substituted or unsubstituted aryl group having 6 to 14 carbon atoms, and as the substituent, those as mentioned above are preferably used. As these —COR group, preferably used are $—COCH_3$, $—COC_2H_5$, $—COC_3H_7$, $—COC_6H_5$, etc., and a halogen-, alkyl-, alkoxy- or phenoxy-substituted compound thereof.

The durene derivative of the present invention can be easily synthesized by, for example, subjecting durene to chloromethylation or dichloromethylation according to a usual method, and then reacting with a hydroxy compound or a carboxy compound.

The durene derivatives represented by the formula (I) are exemplified below with their melting points.

When Z is H (Table 1)

TABLE 1

| Compound No. | Name | Melting point (°C.) |
|---|---|---|
| 1 | p-tert-Octylphenyl-2,3,5,6-tetramethylbenzyl ether | 97.5–98 |
| 2 | p-α-Cumylphenyl-2,3,5,6-tetramethylbenzyl ether | 93–96 |

TABLE 1-continued

| Compound No. | Name | Melting point (°C.) |
|---|---|---|
| 3 | 2,3,5,6-Tetramethylbenzyl p-chlorobenzoate | 103–104 |
| 4 | Cyclohexyl-2,3,5,6-tetramethylbenzyl ether | 109–110 |
| 5 | o-Methylphenyl-2,3,5,6-tetramethylbenzyl ether | 111–112 |
| 6 | m-Methylphenyl-2,3,5,6-tetramethylbenzyl ether | 104–105 |
| 7 | o-iso-Propylphenyl-2,3,5,6-tetramethylbenzyl ether | 87–89 |
| 8 | p-iso-Propylphenyl-2,3,5,6-tetramethylbenzyl ether | 118–120 |
| 9 | o-sec-Butylphenyl-2,3,5,6-tetramethylbenzyl ether | 99–100 |
| 10 | p-Butoxyphenyl-2,3,5,6-tetramethylbenzyl ether | 113–114 |
| 11 | m-Ethylphenyl-2,3,5,6-tetramethylbenzyl ether | 75–76 |
| 12 | 2,4-Dimethylphenyl-2,3,5,6-tetramethylbenzyl ether | 103–105 |
| 13 | 3,4-Dimethylphenyl-2,3,5,6-tetramethylbenzyl ether | 109–112 |
| 14 | 3,5-Dimethylphenyl-2,3,5,6-tetramethylbenzyl ether | 121–123 |
| 15 | 2,3,5,6-Tetramethylbenzyl acetate | 89–90 |
| 16 | 2,3,5,6-Tetramethylbenzyl propionate | 85–86 |
| 17 | 2,3,5,6-Tetramethylbenzyl pivalate | 80–81 |
| 18 | 2,3,5,6-Tetramethylbenzyl p-methylbenzoate | 89–90 |
| 19 | 2,3,5,6-Tetramethylbenzyl p-tert-butylbenzoate | 83–85 |
| 20 | 2,3,5,6-Tetramethylbenzyl p-methoxybenzoate | 121–122 |
| 21 | 2,3-Dimethylphenyl-2,3,5,6-tetramethylbenzyl ether | 121–123 |
| 22 | 2,4,6-Trimethylphenyl-2,3,5,6-tetramethylbenzyl ether | 77–80 |

When Z is $CH_2OX$ (Table 2)

TABLE 2

| Compound No. | Name | Melting point (°C.) |
|---|---|---|
| 23 | p-(2,3,5,6-tetramethyl)xylyleneglycol dibenzyl ether | 106.5–107 |
| 24 | p-(2,3,5,6-Tetramethyl)xylyleneglycol dimethyl ether | 113–113.5 |
| 25 | p-(2,3,5,6-tetramethyl)xylylene-propionate | 122.5–130 |
| 26 | p-(2,3,5,6-Tetramethyl)xylylene-o-chlorobenzoate | 122–124 |
| 27 | p-(2,3,5,6-tetramethyl)xylyleneglycol diethyl ether | 78–81 |
| 28 | p-(2,3,5,6-Tetramethyl)xylyleneglycol dipropyl ether | 37–40 |
| 29 | p-(2,3,5,6-tetramethyl)xylylene-phenoxyacetate | 138–142 |

Next, examples of the leuco dyes to be used in the present invention are shown. These dyes may be used singly or in combination.

3,3-bis(1-ethyl-2-methylindol-3-yl)phthalide, 3,3-bis(1-butyl-2-methylindol-3-yl)phthalide, 3,3-bis(1-pentyl-2-methylindol-3-yl)phthalide, 3,3-bis(1-hexyl-2-methylindol-3-yl)phthalide, 3,3-bis(1-octyl-2-methylindol-3-yl)phthalide, 3-(4-diethylamino-2-ethoxyphenyl)-3-(1-ethyl-2-methylindol-3-yl)phthalide, 3-(4-diethylamino-2-ethoxyphenyl)-3-(1-butyl-2-methylindol-3-yl)phthalide, 3-(4-diethylamino-2-ethoxyphenyl)-3-(1-ethyl-2-methylindol-3-yl)-4-azaphthalide, 3-(4-diethylamino-2-pentyloxyphenyl)-3-(1-ethyl-2-methylindol-3-yl)-4-azaphthalide, 3-(4-diethylamino-2-hexyloxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, 3-(4-diethylamino-2-methylphenyl)-3-(1-ethyl-2-methylindol-3-yl)-4-azaphthalide, 3-(4-diethylamino 2-methylphenyl)-3-(1-pentyl-2-methylindol-3-yl)-4-azaphthalide, 3-(4-diethylamino-2-methylphenyl)-3-(1-hexyl-2-methylindol-3-yl)-4-azaphthalide, 3,3-bis(4-dimethylaminophenyl)-6-dimethylaminophthalide, 3,3-bis[2-(4-dimethylaminophenyl)-2-(4-methoxyphenyl)vinyl]-4,5,6,7-tetrachlorophthalide, 3,3-bis[2-(4-pyrolidinophenyl)-2-(4-methoxyphenyl)vinyl]-4,5,6,7-tetrachlorophthalide, 3,6,6'-tris(dimethylamino)spiro[fluorene-9,3'-phthalide],3-(4-diethylamino-2-methoxyphenyl)-3-(1-(4-chlorophenyl)-1,3-butadienyl)phthalide, 3-chloro-6-cyclohyxylaminofluoran, 2 -chloro-6-diethylaminofluoran, 8-diethylaminobenzo[a]fluoran, 8-ethylisopentylaminobenzo[a]fluoran, 2-anilino-6-ethylhexylaminofluoran, 2-anilino-3-methyl-6-diethylaminofluoran, 2-anilino-3-methyl-6-dibutylaminofluoran, 2-anilino-3-methyl-6-dipentylaminofluoran, 2-anilino-3-methyl-6-methylpropylaminofluoran, 2-anilino-3-methyl-6-ethylisopentylaminofluoran, 2-anilino-3-methyl-6-ethylhexylaminofluoran, 2-anilino-3-methyl-6-ethylisobutylaminofluoran, 2-anilino-3-methyl-6-methylcyclohexylaminofluoran, 2-anilino-3-methyl-6-ethyl-p-tolylaminofluoran, 2-anilino-3-methyl-6-methylethoxypropylaminofluoran, 2-anilino-3-methyl-6-ethylethoxypropylaminofluoran, 2-anilino-3-methyl-6-ethylmethoxypropylaminofluoran, 2-anilino-3-methyl-6-propylethoxypropylaminofluoran, 2-anilino-3-methyl-6-ethyltetrahydrofurfurylaminofluoran, 2-anilino-3-methyl-6-pyrodinofluoran, 2-anilino-3-methyl-6-piperidinofluoran, 2-anilino-3-chloro-6-diethylaminofluoran, 2-o-chloroanilino-6-diethylaminofluoran, 2-o-chloroanilino-6-dibutylaminofluoran, 2-o-chloroanilino-6-ethylisopentylaminofluoran, 2-o-fluoroanilino-6-diethylaminofluoran, 2-o-fluoroanilino-6-dibutylaminofluoran, 2-m-trifluoromethylanilino-6-diethylaminofluoran and 2-chloro-3-methyl-6-{p-(p'-phenylaminophenylamino)phenylamino}fluoran.

Next, examples of color-developing agents to be used in the present invention are shown.

methyl p-hydroxybenzoate, benzyl p-hydroxybenzoate, 2,2-bis(p-hydroxyphenyl)propane (popular name: bisphenol A), 3,4'-isopropylidenediphenol, 2,2-bis(p-hydroxyphenyl)-4-methylpentane, 2,2-bis(4-hydroxy-3-allylphenyl)propane, bis(4-hydroxyphenyl)acetic acid, butyl 1,1-bis(4-hydroxyphenyl)acetate, 4,4'-cyclohexylidenediphenol, 4,4'-thiodiphenol, bis(4-hydroxy-3-methylphenyl)sulfide, bis(4-hydroxy-3-tertiary-butyl-6-methylphenyl)sulfide, 4,4'-dihydroxydiphenylsulfone, 4-hydroxy-4'-methyldiphenylsulfone, 3,4-dihydroxy-4'-methyldiphenylsulfone, 4-hydroxy-4'-isopropoxydiphenylsulfone, 4,4'-dihydroxy-3,3'-dimethyldiphenylsulfone, 4,4'-dihydroxy-3,3'-diallyldiphenylsulfone, dimethyl 4-hydroxyphthalate, bis[2-(4-hydroxyphenylthio)ethyl]ether, 4,4'-methylenebis(oxyethylenethio)diphenol, 1-benzyl-2-naphthol, 1,1'-methylene-di-2-naphthol and p-hydroxyphenylsalicylamide.

The thermosensitive recording material according to the present invention can be prepared, for example, according to the method as shown below. The durene derivative represented by the formula (I), the leuco dye and the color-developing agent are usually separately crushed to a desired particle size with an aqueous solution of a water-soluble polymer such as a polyvinyl alcohol, etc. as a binder by using a crushing machine such as a ball mill, a paint shaker, a sand grinder, etc. Each of the components is mixed with each other, and various additives may be further added to the resulting dispersion in order to satisfy properties as a thermosensitive recording material. More specifically, in order to improve peel-off property from a thermal head, talc, calcium carbonate, zinc stearate, wax, etc. may be used and in order to improve storage stability, a hindered phenol type antioxidant or a benzophenone type, salicylate type or hindered amine type UV absorber, etc. may be added.

The dispersion thus prepared is coated on a support such as a paper, a synthetic paper, a film, etc., and dried to prepare a thermosensitive recording material, but in order to further heighten water resistance and oil resistance, an overcoat layer comprising a polymer substance may be further provided.

The compound represented by the formula (I) may be used singly or in a combination of two or more. An amount to be added is not particularly limited, but usually 50 to 300 parts by weight based on 100 parts by weight of the leuco dye, and 150 to 250 parts by weight is particularly effective. Also, the color-developing agent is generally used in an amount of 100 to 300 parts by weight based on 100 parts by weight of the leuco dye. Also, known sensitizer may be mixed in an amount which does not impair the properties of the compound of the present invention.

Since the thermosensitive recording material according to the present invention comprises a durene derivative as a sensitizer in a recording layer thereof, it has high sensitivity and colors by heat with high density whereby it is extremely available in industry. Further, it occurs no background fog and has sufficient coloring initiation temperature and good image storage stability.

The present invention will be explained more in detail by referring to concrete Examples as follows, but the present invention is not limited by the Examples so long as it does not exceed the purpose of the invention.

EXPERIMENTAL EXAMPLES

Synthesis example 1

(synthesis of Compound No. 1 in Table 1)

To 20 ml of dimethylformamide were added 3.6 g of chloromethyldurene, 4.2 g of p-tert-octylphenol and 2.8 g of anhydrous potassium carbonate, and the mixture was reacted at 100 to 110 C for 8 hours and further reacted at 145 to 150° C. for 7 hours. After cooling, the reaction mixture was poured into 50 ml of water and precipitated crystals were extracted by 50 ml of chloroform, and the organic layer was separated. Chloroform was removed from the extract (the organic layer) and the residue was dried at 60° C. to obtain 8.3 g of a crude product. The crude product was recrystallized from toluene/methanol (v/v ratio : 1/4) and dried at 60° C. to obtain 4.9 g of white crystal (yield: 70.0%).

Synthesis example 2

(synthesis of Compound No. 2 in Table 1)

To 20 ml of dimethylformamide were added 4.7 g of p-α-cumylphenol and 3.0 g of anhydrous potassium carbonate, and after the mixture was stirred at 80° C. for 30 minutes, 3.6 g of chloromethyldurene was added at the same temperature over 30 minutes. Then, the mixture was reacted at 80° C. for 2 hours, at 100° to 110° C. for 4 hours and further at 140° C. for 6 hours. After cooling, the reaction mixture was poured into 50 ml of water and precipitated crystals were collected by filtration, washed with water and dried at 60° C. to obtain 7.1 g of a crude product. The crude product was recrystallized from toluene/methanol (v/v ratio : 10/1) and dried at 60 C to obtain 5.1 g of white crystal (yield: 71.1%).

Synthesis example 3

(synthesis of Compound No. 3 in Table 1)

To 20 ml of dimethylformamide were added 3.4 g of p-chlorobenzoic acid and 3.0 g of anhydrous potassium carbonate, and after stirring at 100° C. for one hour and a half, 3.6 g of chloromethyldurene was added at 80° C. Then, the mixture was reacted at 90° C. for 2 hours. After cooling, the reaction mixture was poured into 50 ml of water and precipitated crystals were collected by filtration, washed with water and dried at 60° C. to obtain 6.06 g of a crude product. The crude product was recrystallized from toluene/methanol (v/v ratio:1/5) and dried at 60° C. to obtain 4.6 g of white crystal (yield: 75.3%).

Synthesis examples 4 to 22

By using substantially the same methods as in Synthesis examples 1 to 3, Compounds No. 4 to No. 22 in Table 1 were each synthesized.

Synthesis example 23

(Synthesis of Compound No. 23 in Table 2)

To 5.4 g of benzyl alcohol were added 4.6 g of bis(chloromethyl)durene and 3.9 g of 85% potassium hydroxide and the mixture was reacted at 100° to 110° C. for 3 hours. After cooling, precipitated crystals were collected by filtration and dried at 60° C. to obtain 6.3 g of a crude product. The crude product was recrystallized from methanol and dried at 60° C. to obtain 5.9 g of white crystal (yield: 75.4%).

Synthesis example 24

(Synthesis of Compound No. 24 in Table 2)

To 7.7 g of a methanol solution of 28% sodium methylate was added 4.6 g of bis(chloromethyl)durene, and the mixture was reacted under reflux for 5 hours. After cooling, the reaction mixture was poured into 50 ml of water and precipitated crystals were collected by filtration, washed with water and dried at 60° C. to obtain 3.6 g of a crude product. The crude product was recrystallized from methanol and dried at 60° C. to obtain 3.3 g of white crystal (yield: 74.2%).

Synthesis example 25

(Synthesis of Compound No. 25 in Table 2)

To 20 ml of dimethylformamide were added 4.6 g of bis(chloromethyl)durene and 4.2 g of sodium propionate, and the mixture was reacted at 100° to 110° C. for 2 hours. After cooling, the reaction mixture was poured into 50 ml of water and precipitated crystals were extracted with 50 ml of chloroform, and the organic layer was separated. Chloroform was removed from the extract (the organic layer) and the residue was dried at 60° C. to obtain 5.8 g of crude product. The crude product was recrystallized from toluene/methanol (v/v ratio:

1/3.5) and dried at 60° C. to obtain 5.1 g of white crystal (yield: 83.3%).

Synthesis example 26

(Synthesis of Compound No. 26 in Table 2)

To 40 ml of dimethylformamide were added 6.9 g of bis(chloromethyl)durene, 10.3 g of o-chlorobenzoic acid and 9.1 g of anhydrous potassium carbonate, and the mixture was reacted at 90° C. for 1 hours. After cooling, the reaction mixture was poured into 100 ml of water and precipitated crystals were extracted with 100 ml of chloroform, and the organic layer was separated. Chloroform was removed from the extract (the organic layer) and the residue was dried at 60° C. to obtain 12.7 g of a crude product. The crude product was recrystallized from toluene/methanol (v/v ratio: 2/1) and dried at 60° C. to obtain 11.8 g of white crystal (yield: 84.0 %).

Synthesis examples 27 to 29

By using substantially the same methods as in Synthesis examples 23 to 26, Compounds No. 27 to No. 29 in Table 2 were each synthesized.

EXAMPLE 1

(Preparation of thermosensitive recording paper)

1) Preparation of coloring agent (leuco dye) dispersion (Liquid A)

| | |
|---|---|
| 2-Anilino-3-methyl-6-ethyl-iso-pentylamino-fluoran | 1.0 part |
| Papirol N680C (binder, available from Showa Denko K.K., polyvinyl alcohol concentration: 30%) | 3.0 parts |
| Water | 20.0 parts |

The above mixture was pulverized with a sand grinder (manufactured by Aimex K.K.) until an average particle diameter of the coloring agent becomes 1 micron.

2) Preparation of color-developing agent dispersion (Liquid B)

| | |
|---|---|
| Hidorin F-285 (available from Chukyo Yushi K.K., 50% bisphenol A dispersion) | 5.0 parts |
| Hidorin Z-7-30 (available from Chukyo Yushi K.K., 30% fatty acid zinc dispersion) | 2.0 part |
| Mizukasil P-832 (available from Mizusawa Kagaku K.K., calcium silicate) | 4.0 parts |
| Water | 4.0 parts |

The above mixture was sufficiently mixed with a magnetic stirrer.

3) Preparation of sensitizer dispersion (Liquid C)

| | |
|---|---|
| o-sec-Butylphenyl-2,3,5,6-tetramethylbenzyl ether (Compound No. 9) | 2.0 parts |
| Papirol N680C | 3.0 parts |
| Water | 7.0 parts |

The above mixture was pulverized with a sand grinder until an average particle diameter becomes 1.5 microns.

4) Preparation of thermosensitive coating solution and coating thereof.

4.0 parts of Liquid A, 2.0 parts of Liquid B and 3.0 parts of Liquid C were mixed and stirred to obtain a thermosensitive coating solution. This coating solution was coated with a wire bar on a paper uniformly so as to become a weight after drying being 6 g/m2, and dried to obtain a thermosensitive recording paper (a).

This thermosensitive recording paper does not show any discoloration of the background and rapidly colored to dark black color by heating with a thermal pen, etc. Also, a coating surface has excellent light resistance, occurs no coloring by sunlight irradiation and also has excellent image storage stability.

EXAMPLES 2 to 5

In the same manner as in Example 1 except for using the compound No. 6 (Example 2), No. 3 (Example 3), No. 2 (Example 4) or No. 18 (Example 5) as a sensitizer in Liquid C, Liquids A, B and C were prepared, and these Liquids were mixed and coated on a paper to prepare recording papers (b) to (e), respectively.

EXAMPLES 6 to 8

In the same manner as in Example 1 except for using the compound No. 23 (Example 6), No. 24 (Example 7) or No. 25 (Example 8) as a sensitizer in Liquid C, Liquids A, B and C were prepared, and these Liquids were mixed and coated on a paper to prepare recording papers (f) to (h), respectively.

Recording papers in Examples 2 to 8 had substantially the same properties as that of Example 1.

COMPARATIVE EXAMPLE 1

In the same manner as in Example 1 except for using stearic acid amide as a sensitizer in Liquid C, Liquids A, B and C were prepared, and these Liquids were mixed and coated on a paper to prepare a recording paper (i).

EXAMPLE 9

(Tests of coloring characteristics)

Test method of coloring characteristics

In order to examine coloring sensitivities of thermosensitive recording papers (a) to (i) prepared by the methods of Examples 1 to 8 and Comparative example 1, these papers were colored by using a thermal tester (manufactured by Okura Denki K.K.) with an applied voltage of 16V and a pulse width of 1.8 msec. Reflection densities of the resulting image portions were measured by using Macbeth reflection densitometer RD-514 (using a latten #106 filter).

The results of the respective reflection densities obtained are shown in Table 3.

TABLE 3

| Thermosensitive recording paper | Sensitizer | Reflection density of an image portions* |
|---|---|---|
| (a) | o-(sec-Butylphenyl)-2,3,5,6-tetramethylbenzyl ether | 1.21 |
| (b) | m-Methylphenyl-2,3,5,6-tetramethylbenzyl ether | 1.19 |
| (c) | 2,3,5,6-Tetramethylbenzyl p-chlorobenzoate | 1.17 |
| (d) | p-α-Cumylphenyl-2,3,5,6-tetramethylbenzyl ether | 1.15 |
| (e) | 2,3,5,6-Tetramethylbenzyl p-methylbenzoate | 1.13 |
| (f) | p-(2,3,5,6-tetramethyl)xylyleneglycol dibenzyl ether | 1.14 |
| (g) | p-(2,3,5,6-Tetramethyl)xylyleneglycol dimethyl ether | 1.18 |
| (h) | p-(2,3,5,6-tetramethyl)xylylene | 1.12 |

TABLE 3-continued

| Thermosensitive recording paper | Sensitizer | Reflection density of an image portions* |
|---|---|---|
| | propionate | |
| (i) | Stearic acid amide | 0.95 |

*As reflection density of an image portion, 1.10 or higher is preferred.

As shown in Table 3, the thermosensitive recording papers using the sensitizers of the present invention had higher coloring density at a pulse width of 1.8 msec. as compared with the thermosensitive recording paper (i) obtained in Comparative example 1, respectively. This means that the sensitizer of the present invention has high sensitizing effect.

It can be confirmed that the durene derivatives used in the present invention are extremely available compounds showing excellent effects as a sensitizer.

What is claimed is:

1. A thermosensitive recording material comprising a support and a recording layer containing a leuco dye, a color-developing agent which reacts with said dye so as to form a color by heating and at least one of durene derivatives represented by the formula (I):

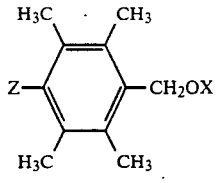

(I)

wherein Z represents $CH_2OX$ or H, X represents an alkyl group, a cycloalkyl group, a substituted or unsubstituted aralkyl group or aryl group, or —COR group where R represents an alkyl group or a substituted or unsubstituted aryl group.

2. The thermosensitive recording material according to claim 1, wherein said durene derivative is contained in an amount of 50 to 300 parts by weight based on 100 parts by weight of the leuco dye.

3. The thermosensitive recording material according to claim 1, wherein said color-developing agent is contained in an amount of 100 to 300 parts by weight based on 100 parts by weight of the leuco dye.

* * * * *